US008187007B2

(12) United States Patent
Emde et al.

(10) Patent No.: US 8,187,007 B2
(45) Date of Patent: May 29, 2012

(54) ELECTRICAL PRESSFIT PLUG CONNECTOR HAVING A LATERALLY BENT POWER PIN

(75) Inventors: Christoph Emde, Leingarten (DE); Ruediger Schoen-Hermenau, Ludwigsburg (DE); Mitja Buhmann, Rettigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/736,824

(22) PCT Filed: Mar. 17, 2009

(86) PCT No.: PCT/EP2009/053117

§ 371 (c)(1),
(2), (4) Date: Feb. 11, 2011

(87) PCT Pub. No.: WO2009/138277

PCT Pub. Date: Nov. 19, 2009

(65) Prior Publication Data

US 2011/0130053 A1 Jun. 2, 2011

(30) Foreign Application Priority Data

May 15, 2008 (DE) ..... 10 2008 001 787

(51) Int. Cl.
*H01R 12/00* (2006.01)

(52) U.S. Cl. ..... 439/78; 439/751; 439/82

(58) Field of Classification Search ..... 439/78, 439/82, 751
See application file for complete search history.

(56) References Cited

U.S. PATENT DOCUMENTS

| | | | | |
|---|---|---|---|---|
| 5,240,422 | A | 8/1993 | Kobayashi et al. | |
| 5,630,720 | A * | 5/1997 | Kocher | 439/78 |
| 6,171,133 | B1 * | 1/2001 | Altuner et al. | 439/381 |
| 6,464,542 | B1 | 10/2002 | Lee | |
| 6,688,895 | B1 * | 2/2004 | Fan | 439/82 |
| 6,830,465 | B2 * | 12/2004 | Norris et al. | 439/76.1 |
| 7,189,081 | B2 * | 3/2007 | Tanaka et al. | 439/76.2 |

FOREIGN PATENT DOCUMENTS

| | | |
|---|---|---|
| EP | 0 901 188 | 3/1999 |
| EP | 1 643 597 | 4/2006 |
| EP | 1 713 147 | 10/2006 |

* cited by examiner

*Primary Examiner* — Gary F. Paumen
(74) *Attorney, Agent, or Firm* — Kenyon & Kenyon LLP

(57) ABSTRACT

An electrical pressfit plug connector for fastening to a printed circuit board includes contacts, which on the front side and back side of the plug connector are each situated as a single or multi-row male multipoint connector, and which are configured on the front side of the plug connector as contact pins for contacting a counterplug, and are configured on the back side as pressfit pins for pressfitting into metallized bores in the printed circuit board, according to the present system, either the contact pin or the pressfit pin of at least one contact of the male multipoint connectors being situated laterally offset with respect to its associated pressfit pin and contact pin, respectively, in the longitudinal direction of the male multipoint connectors.

12 Claims, 1 Drawing Sheet

ELECTRICAL PRESSFIT PLUG CONNECTOR HAVING A LATERALLY BENT POWER PIN

FIELD OF THE INVENTION

The present invention is based on an electrical pressfit plug connector.

BACKGROUND INFORMATION

An electrical pressfit plug connector is discussed in EP 0 901 188 A2, for example.

In today's control units in printed circuit board technology, the electrical connection from the customer plug to the printed circuit board is produced using pressfit plug connectors, whose contacts are configured at one end as contact pins of a front side male multipoint connector for contacting the customer plug and at the other end as deformable pressfit pins of a back side male multipoint connector for pressfitting in sleeves or metallized bores in the printed circuit board. A gas-tight and electrically conductive connection is created by the pressfitting, between the pressfit pins and the printed circuit board bores. In the known pressfit plug connectors, the pressfit pins and the contact pins of the individual contacts are each symmetrical to the center line or center plane of their contacts. This has the result that not only the position of the contact pins within the pressfit plug connector is predefined because of the customer plug, but also the positions of the metallized bores in the printed circuit board.

Various customer plugs having different pin numbers, pin positions, etc., have to be implemented within one control unit family. The width of the pressfit plug connector also increases with the number of pins. In control units having compact housing dimensions, the customer plug may be determinative of size, that is, the width of the pressfit plug connector may be smaller than the width of the customer plug. In order to contact all the plug contacts of the customer plug, the printed circuit board of such control units has to be configured wider in the plug area, for pressfitting a correspondingly wide pressfit plug connector. This widening of the printed circuit board in the plug area leads to an unusable area of the printed circuit board, which is cut away during the printed circuit board production. The non-optimal utilization of the bulk substrate, in connection with this, leads to an increase in costs per individual use.

SUMMARY OF THE INVENTION

According to the exemplary embodiments and/or exemplary methods of the present invention, it is provided that one should position the contact pins and pressfit pins of one or more outer contacts of the pressfit plug connector in a manner offset laterally to one another, in order that one may use the same printed circuit board contour (narrow printed circuit board having no cut-away portion), optimized as to utilization, for both narrow and wide customer plugs. In other words, because of the pressfit plug connector according to the present invention, an adaptor is provided which is able to map, for instance, a wide printed circuit board onto a narrow customer plug or a narrow printed circuit board onto a wide customer plug, whereby additional degrees of freedom come about in the printed circuit board geometry. Consequently, one may use small, and thus cost-effective printed circuit boards even in control units having wide customer plugs.

If, for example, the customer plugs differ only in the number of contacts (identical contact spacing of the pins), and with that, in their width, the interface to the printed circuit board, that is internal to the control unit, is able to be standardized. Thereby, control units having different customer plug variants are able to be constructed using one printed circuit board type. This reduces the variance in printed circuit board layouts (lower logistics cost and release cost) and decouples the development of new control unit housings from the development of layouts.

Further advantages and advantageous embodiments of the subject matter of the exemplary embodiments and/or exemplary methods of the present invention are derivable from the description, the drawings and otherwise herein.

Two exemplary embodiments of the pressfit plug connector according to the present invention are depicted in the drawings and are elucidated more closely in the following description. The features shown in the figures are purely schematic, and are not to be regarded as being to scale.

DETAILED DESCRIPTION

Figure 1:
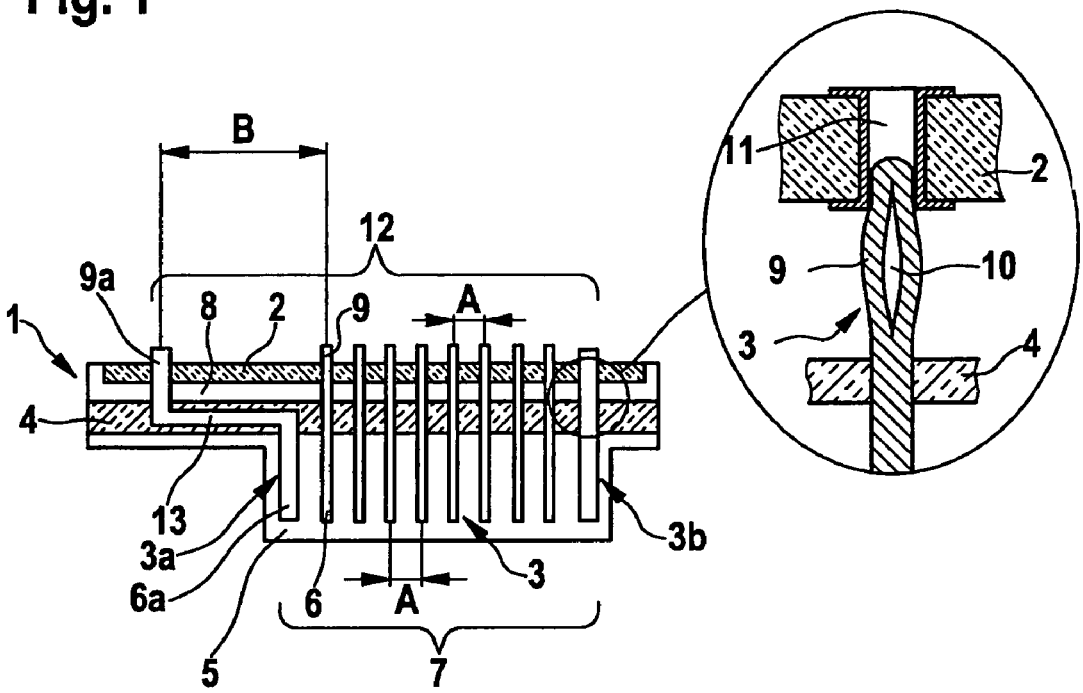
FIG. 1 shows the pressfit plug connector, according to the present invention, that is fastened on a printed circuit board, having a pressfit pin of a power pin that is bent laterally outwards.

Electrical pressfit plug connector 1, shown in FIG. 1, is fastened on a printed circuit board 2, using a pressfit technique.

Pressfit plug connector 1 includes electrical contacts 3, which are fastened in the bores of a contact carrier plate 4 that is made of electrically insulating material, and project on both sides of contact carrier plate 4. On the one side of contact carrier plate 4, namely, on the front side 5 facing away from the printed circuit board of plug connector 1, contacts 3 are configured as parallel contact pins 6 for contacting a customer plug or counterplug, and situated as a male multipoint connector 7 (contact spacing A). On the other side of contact carrier plate 4, namely, on back side 8, facing the printed circuit board, of pressfit plug connector 1, contacts 3 are configured as parallel, deformable pressfit pins 9, having a springy core 10 for pressfitting in metallized bores 11 in printed circuit board 2, and are also situated as a male multipoint connector 12 (contact spacing A). The two male multipoint connectors 7, 12, having the same contact spacing A, are aligned parallel to each other, and may be configured to have single or multi-rows.

Outermost left and right contacts 3*a*, 3*b* of plug connector 1, because of their greater cross section with respect to remaining contacts 3, are used as contact pins for higher currents, and are designated as "power pins". The diameter of power pins 3*a*, 3*b* may, in particular, also be equal to, or greater than contact spacing A of the remaining contacts 3, and in the case of multi-row male multipoint connectors, may in particular also be equal to, or greater than the distance between the contact rows.

Pressfit pin 9*a* of left power pin 3*a*, in the longitudinal direction of male multipoint connectors 7, 12 in the direction away from right power pin 3*b*, that is, to the left, is situated laterally offset with respect to its associated contact pin 6*a*. Putting it more accurately, left power pin 3*a* has, between its pressfit pin 9*a* and its contact pin 6*a*, a middle contact section 13, running within contact carrier plate 4 in the longitudinal direction of male multipoint connector 7, 12, with respect to which contact pin 6*a* and pressfit pin 9*a* are each bent by 90°. Contact-free distance B, between laterally offset pressfit pin 9*a* of left power pin 3*a* and non-offset pressfit pin 9 of next adjacent contact 3, may correspond to an integer multiple of contact spacing A of the back side of male multipoint connector 12.

Using the design of printed circuit board 2 shown in FIG. 1, by having contact sections 13 of power pin 3*a*, that are of different lengths, as well as by having a laterally offset arrangement of contact pin 6*a* of power pin 3*a* either to the right, as shown in FIG. 1, or to the left, customer plugs of different widths, that is, customer plugs having a different number of plug contacts are able to be implemented. The number of signals, in this case, is limited to the cut set of the contacts of pressfit plug connector 1 and customer plugs, which means that for the combination of a wide plug connector having a narrow printed circuit board (FIG. 2), not all the contacts of the customer plug are able to be connected, since in the region of contact-free distance B there are no contact pins. In the case of wider printed circuit boards 2, power pin 3*a*, that is offset laterally inwards, has the advantage that even narrower customer plugs, having fewer plug pins, may be implemented, without one's having to change printed circuit board 2.

Figure 2:
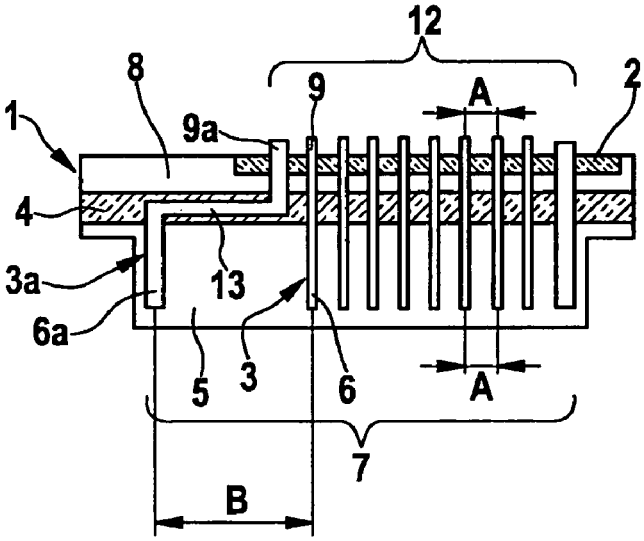
FIG. 2 shows the pressfit plug connector, according to the present invention, that is fastened on a printed circuit board, having a pressfit pin of a power pin that is bent laterally inwards.

Pressfit plug connector 1 shown in FIG. 2 differs from the pressfit plug connector of FIG. 1 only in that, in reverse, in this case, contact pin 6*a* of left power pin 3*a* is situated offset to the left, with respect to pressfit pin 9*a*. Contact-free distance B, between laterally offset contact pin 6*a* of left power pin 3*a* and non-offset contact pin 6 of next adjacent contact 3, may correspond to an integer multiple of contact spacing A of the front side of male multipoint connector 7.

In the case of pressfit plug connectors 1, shown in FIGS. 1 and 2, since the distances B that are to be bridged in the combinations wide printed circuit board 2 and narrow front side male multipoint connector 7 (FIG. 1)

narrow printed circuit board 2 and wide front side male multipoint connector 7 (FIG. 2)

are the same, the same parts may be used for bent power pins 3*a*, which again reduces the variance in mechanical parts.

In pressfit plug connectors 1 shown in FIGS. 1 and 2, only in the case of left power pin 3*a*, are contact pin 6*a* and pressfit pin 9*a* situated laterally offset with respect to each other. In other specific embodiments that are not shown, in addition, also contact pin 6*a* and pressfit pin 9*a* are situated laterally offset with respect to each other, whereby plug connector 1 is symmetrical to its center plane and is able to be situated symmetrically to printed circuit board 2.

By contrast to pressfit plug connectors 1 shown in FIGS. 1 and 2, in which the two male multipoint connectors 7, 12 are aligned in parallel to each other, the two male multipoint connectors 7, 12 may also be at an angle of what may be 90° with respect to each other.

What is claimed is:

1. An electrical pressfit plug connector for fastening to a printed circuit board, comprising:

contacts, which on a front side and a back side of the plug connector, are each situated as a single or multi-row male multipoint connector, and which are configured on the front side of the plug connector as contact pins for contacting a counterplug, and are configured on the back side as pressfit pins for pressfitting in metallized bores in the printed circuit board;

wherein one of the contact pin and the pressfit pin of at least one contact of the male multipoint connectors is situated laterally offset with respect to its associated pressfit pin and contact pin, respectively, in the longitudinal direction of the male multipoint connectors;

wherein the contact, having the contact pins and pressfit pins that are situated laterally offset with respect to each other, between its contact pins and pressfit pins has a middle contact section running in a longitudinal direction of the male multipoint connectors, with respect to which the contact pins and pressfit pins are each bent off;

wherein the contacts are fastened in a contact carrier plate between the two male multipoint connectors, and wherein the middle contact section is situated entirely within the contact carrier plate.

2. The pressfit plug connector of claim 1, wherein at least one end of the male multipoint connectors, there is a contact having contact pins and pressfit pins that are laterally offset to one another.

3. The pressfit plug connector of claim 1, wherein the lateral distance between the pressfit pin of the contact, which is situated laterally offset, and the pressfit pin of its adjacent non-offset contact corresponds to an integer multiple of the contact spacing of the back side of the male multipoint connector.

4. The pressfit plug connector of claim 1, wherein the lateral distance between the contact pin of the contact, which is situated laterally offset, and the contact pin of its adjacent non-offset contact corresponds to an integer multiple of the contact spacing of the front side of the male multipoint connector.

5. The pressfit plug connector of claim 1, wherein the contact having the contact pins and pressfit pins, which are situated laterally offset with respect to each other, has a greater cross section than the remaining contacts that are not laterally offset.

6. The pressfit plug connector of claim 1, wherein the contact pins and pressfit pins are each bent off by 90°.

7. An electrical pressfit plug connector for fastening to a printed circuit board, comprising:

contacts, which on a front side and a back side of the plug connector, are each situated as a single or multi-row male multipoint connector, and which are configured on the front side of the plug connector as contact pins for contacting a counterplug, and are configured on the back side as pressfit pins for pressfitting in metallized bores in the printed circuit board;

wherein one of the contact pin and the pressfit pin of at least one contact of the male multipoint connectors is situated laterally offset with respect to its associated pressfit pin and contact pin, respectively, in the longitudinal direction of the male multipoint connectors;

wherein all contact pins are situated in parallel, having identical contact spacing, in at least one male multipoint connector except for an outermost contact at at least one end of the male multipoint connector, the outermost contact being configured as a power pin and having the contact pin and the pressfit pin that are situated laterally offset with respect to each other, a middle contact section running in the longitudinal direction of the male multipoint connector between the contact pin and the pressfit pin, with respect to which the contact pin and the pressfit pin are each bent off.

8. The pressfit plug connector of claim 7, wherein the contact pin and the pressfit pin are each bent off by 90°.

9. The pressfit plug connector of claim 7, wherein the contacts are fastened in a contact carrier plate between the two male multipoint connectors, and wherein the middle contact section is situated within the contact carrier plate.

10. The pressfit plug connector of claim 7, wherein the lateral distance between the pressfit pin of the contact, which is situated laterally offset, and the pressfit pin of its adjacent non-offset contact corresponds to an integer multiple of the contact spacing of the back side of the male multipoint connector.

11. The pressfit plug connector of claim 7, wherein the lateral distance between the contact pin of the contact, which is situated laterally offset, and the contact pin of its adjacent non-offset contact corresponds to an integer multiple of the contact spacing of the front side of the male multipoint connector.

12. The pressfit plug connector of claim 7, wherein the contact having the contact pin and pressfit pin, which are situated laterally offset with respect to each other, has a greater cross section than the remaining contacts that are not laterally offset.

* * * * *